US006171154B1

(12) United States Patent
Juntwait et al.

(10) Patent No.: US 6,171,154 B1
(45) Date of Patent: Jan. 9, 2001

(54) DEVICE BAY CONNECTOR

(75) Inventors: Eric Juntwait, Irvin, CA (US); George Lee, Taipei; Jerry Wu, Chang-Hua Hsien, both of (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/182,026

(22) Filed: Oct. 29, 1998

(51) Int. Cl.[7] ..... H01R 13/64; H01R 13/40; H01R 13/502

(52) U.S. Cl. ..... 439/752.5; 439/381; 439/598; 439/599; 439/695

(58) Field of Search ..... 439/752.5, 381, 439/598, 599, 695

(56) References Cited

U.S. PATENT DOCUMENTS 4,721,478 * 1/1988 Sonobe ..... 439/598

* cited by examiner

*Primary Examiner*—Paula Bradley
*Assistant Examiner*—Edwin A. León
(74) *Attorney, Agent, or Firm*—Wei Te Chung

(57) ABSTRACT

An electrical connector comprises a dielectric housing having a front face and a rear face opposite the front face. A mating portion extends from the rear face for mating with a complementary connector. A first contact section is integrally formed on the front face for connecting with a first connector. A second contact section is integrally formed on the front face for connecting with a second connector and includes at least a contact pin extending beyond the front face. An alignment plate having an opening for insertion of the contact pin is assembled to the front face for securely positioning the contact pin.

2 Claims, 10 Drawing Sheets

DEVICE BAY CONNECTOR

FIELD OF THE INVENTION

The present invention relates to a connector, and more particularly to a Device Bay connector having an alignment plate for ensuring correct alignment of contact pins assembled therein.

DESCRIPTION OF THE PRIOR ART

Device Bay is a new form factor standard proposed by the Device Bay promoters, Compaq, Microsoft and Intel that leverages off two emerging industry standard serial interfaces USB and IEEE 1394. The Device Bay enables ease-of-use, modular expansion and security among other benefits. For manufacturers, Device Bay enables architectural flexibility. Device Bay can be implemented in many applications such as desktop/laptop computers, workstation, servers, consumer electronics, test/measurement, data acquisition, industrial control, medical, etc. Buckhead receptacle connector is used on systems with one or two bays where the bays opening are facing toward different directions of the system. Example Device Bays implementation please refer to FIG. 2, Page 8 of Device Bay Design Guide [V0.4 Draft], or web site http://www.device-bay.org/.

As shown in FIGS. 1 and 2, the buckhead receptacle connector 90 includes a power plug connector 91 for connection with a receptacle connector 92. The Buckhead connector 90 further includes insulation displacement sections 95 for termination with a flat cable 96. The Buckhead connector 90 forms a mating portion 97 for connection with a complementary connector (not shown).

The plug connector 91 utilizes a contact 91*a* having a U-shaped header portion 91*b* and a plate portion 91*c*. Three cantilevered arms 91*d* extend from the plate portion 91*c* for connecting with a complementary connector (not shown). In order to assemble the contact 91*a* to the plug connector 91, the plug connector 91 defines six (6) passageways 91*f* for securely receiving the contacts 91*a* therein, as shown in FIGS. 3 and 4. Each passageway 91*f* defines a main channel 91*g* for receiving the header portion 91*b*, a flat channel 91*h* for receiving the plate portion 91*c*, and three channels 91*i* for receiving cantilevered arms 91*d*. In order to facilitate insertion of the contact 91*a* into the corresponding passageway 91*f*, the dimension of the passageway 91*f* is larger than the dimension of the contact 91*a*. Furthermore, in order to prevent the cantilevered arms 91*d* from being deformed during assembly, the contact 91*a* must be inserted into the passageway 91*f* along direction A. However, after insertion the header portion 91*b* can be moved transversely because clearance exists between walls of the header portion 91*b* and inner walls of the passageway 91*f*. If the header portion 91*b* is shifted from a correct position, engagement between the header portion 91*b* and the complementary receptacle (not shown) will be hindered. FIG. 5 is a cross sectional view showing two contacts 91*a* assembled within the passageways 91*f* wherein lower portions of the header portions 91*b* are not firmly supported by the housing of the plug connector.

SUMMARY OF THE INVENTION

An objective of this invention is to provide a connector having an alignment plate for ensuring correct alignment of contact pins thereof.

Another objective of this invention is to provide a connector having an alignment plate assembled therein for enhancing engagement of contact pins with a housing of said connector.

In order to achieve the objectives set forth, an electrical connector comprises a dielectric housing defining a front face and a rear face opposite the front face. A mating portion extends from the rear face for mating with a complementary connector. A first contact section is integrally formed on the front face for connecting with a first connector. A second contact section is integrally formed on the front face for connecting with a second connector and includes at least a contact pin extending beyond the front face. An alignment plate having an opening for insertion of the contact pin is assembled to the front face for securely positioning the contact pin.

According to one aspect of a first embodiment of the present invention, a peripheral wall extends from the front face defining a receiving space for surrounding the contact pin therein and the alignment plate is interferentially engaged with inner faces of the peripheral wall. Recesses are defined in an inner face of the wall for retention of tabs of the alignment plate.

According to another aspect of the first embodiment of the present invention, the front face defines a recess for securely retaining the alignment plate therein and a pair of clips extend into the recess for retention of the alignment plate.

According to a second embodiment of the present invention, an electrical connector comprises a dielectric housing defining a front face and a rear face opposite the front face. A mating portion extends from the rear face for mating with a complementary connector. A first contact section is integrally formed on the front face for connecting with a first connector. A second contact section is integrally formed on the front face for connecting with a second connector and includes at least a pair of contact pins extending beyond the front face. An alignment plate having at least a pair of openings for insertion of the contact pins is assembled to the contact pins by interferential engagement between inner faces of the opening and body portions of the contact pins.

According to one aspect of the second embodiment of the present invention, a peripheral wall extends from the front face defining a receiving space for surrounding the contact pin therein. The alignment plate is interferentially engaged with inner faces of the peripheral wall. Recesses are defined in the inner faces of the wall for retention of tabs of the alignment plate.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
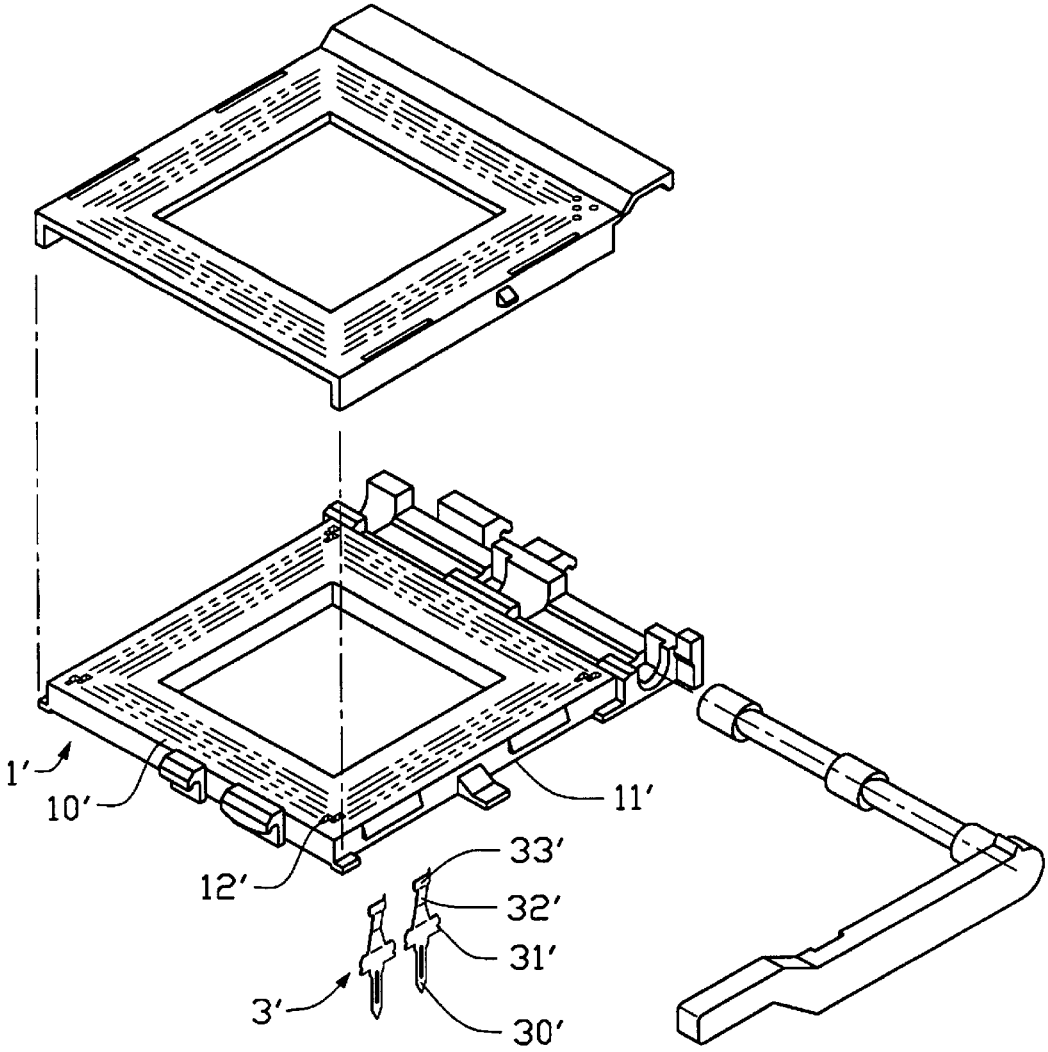
FIG. 1 (PRIOR ART)
FIG. 1 is a perspective view showing a power plug and a conventional buckhead receptacle connector.
Figure 2:
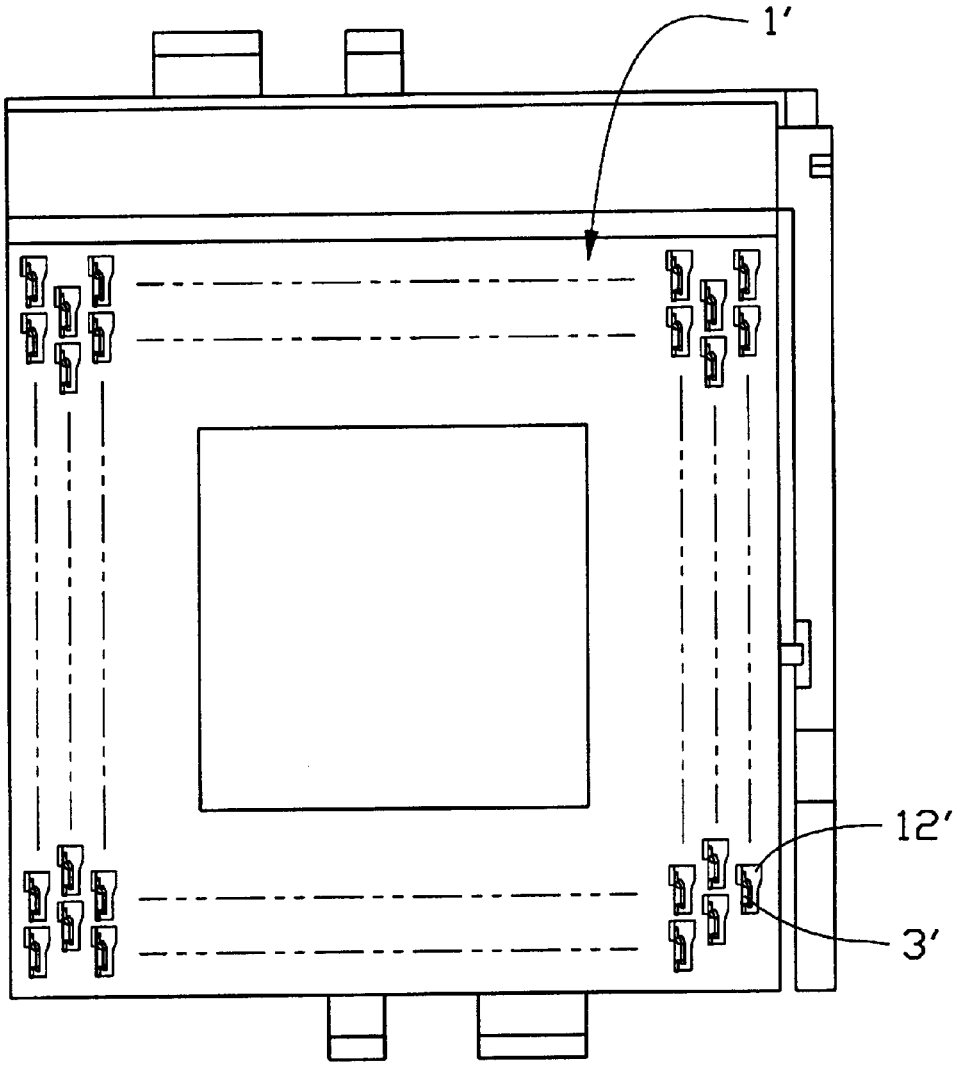
FIG. 2 (PRIOR ART)
FIG. 2 is a perspective view of a conventional contact for use with the buckhead receptacle connector.
Figure 3:
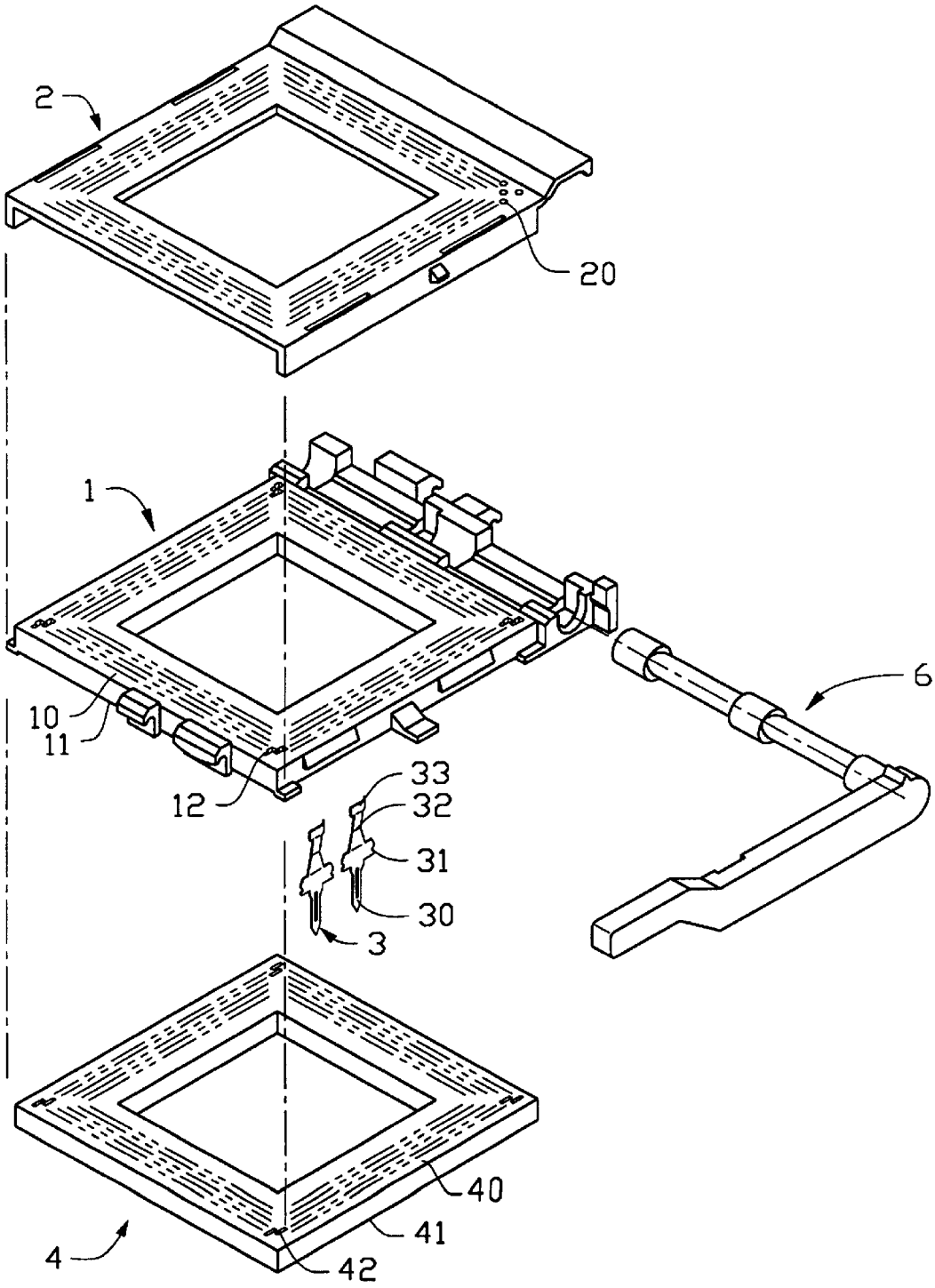
FIG. 3 is a front view of an individual passageway of the buckhead receptacle connector of FIG. 1.
Figure 4:
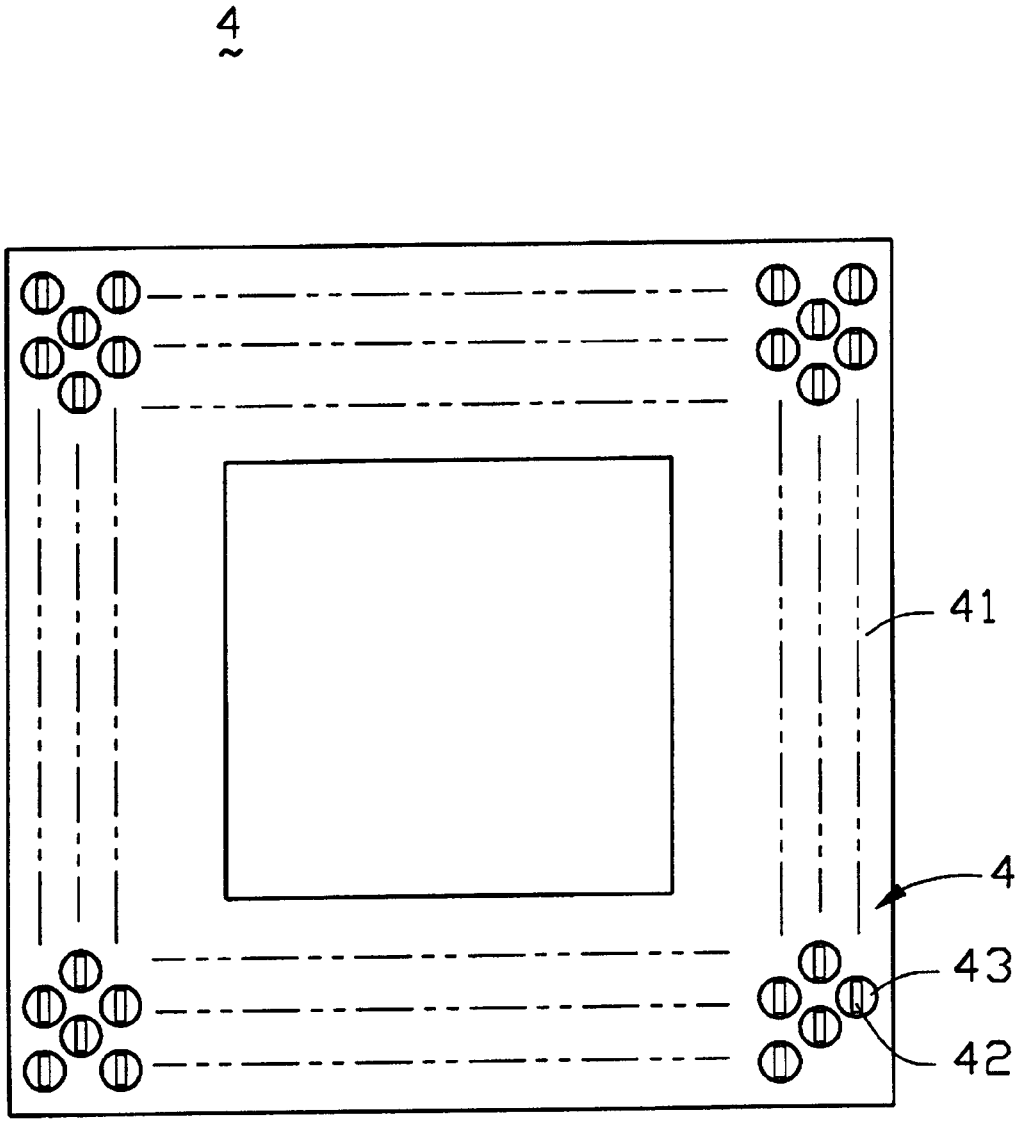
FIG. 4 is a cross sectional view of a passageway of FIG. 1.
Figure 5:
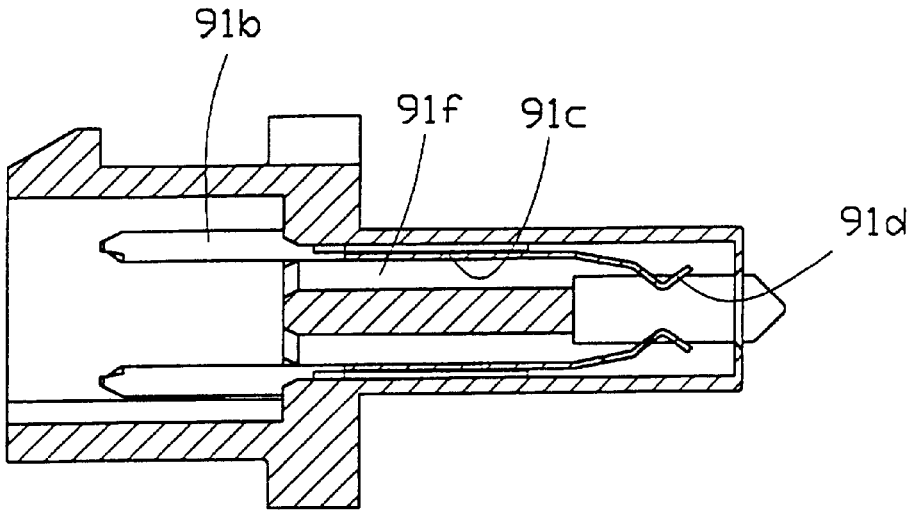
FIG.5 (PRIOR ART)
FIG. 5 is a view similar to FIG. 4 except contact pins are assembled therein.
Figure 6:
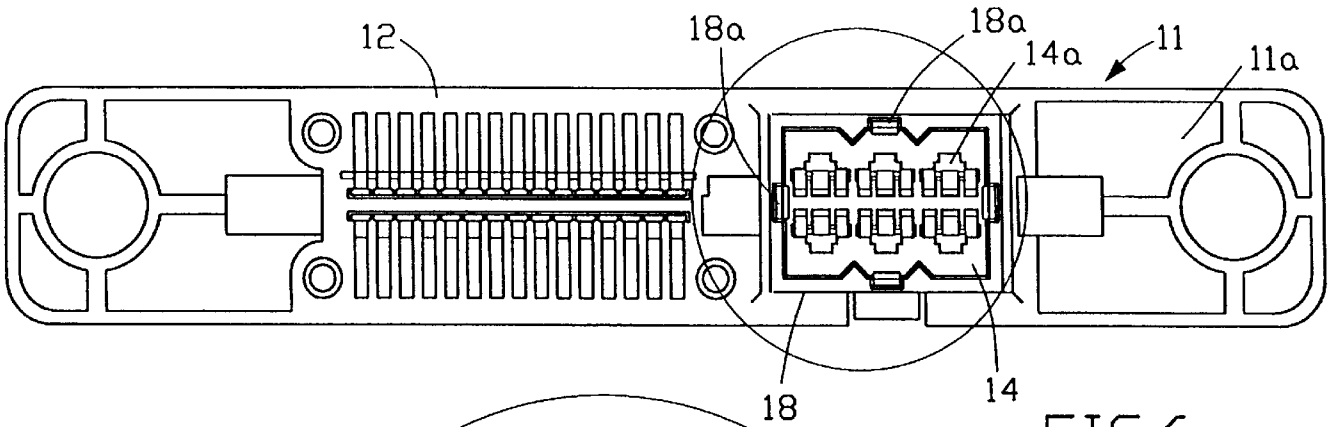
FIG. 6 is a front view of the buckhead connector in accordance with the present invention.
Figure 6A:
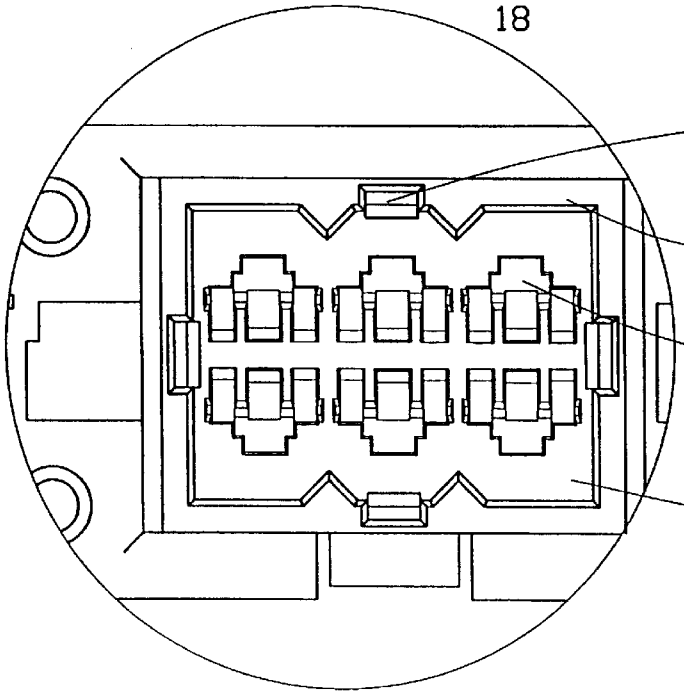
FIG. 6A is an enlarged view of the encircled portion of FIG. 6.
Figure 10:
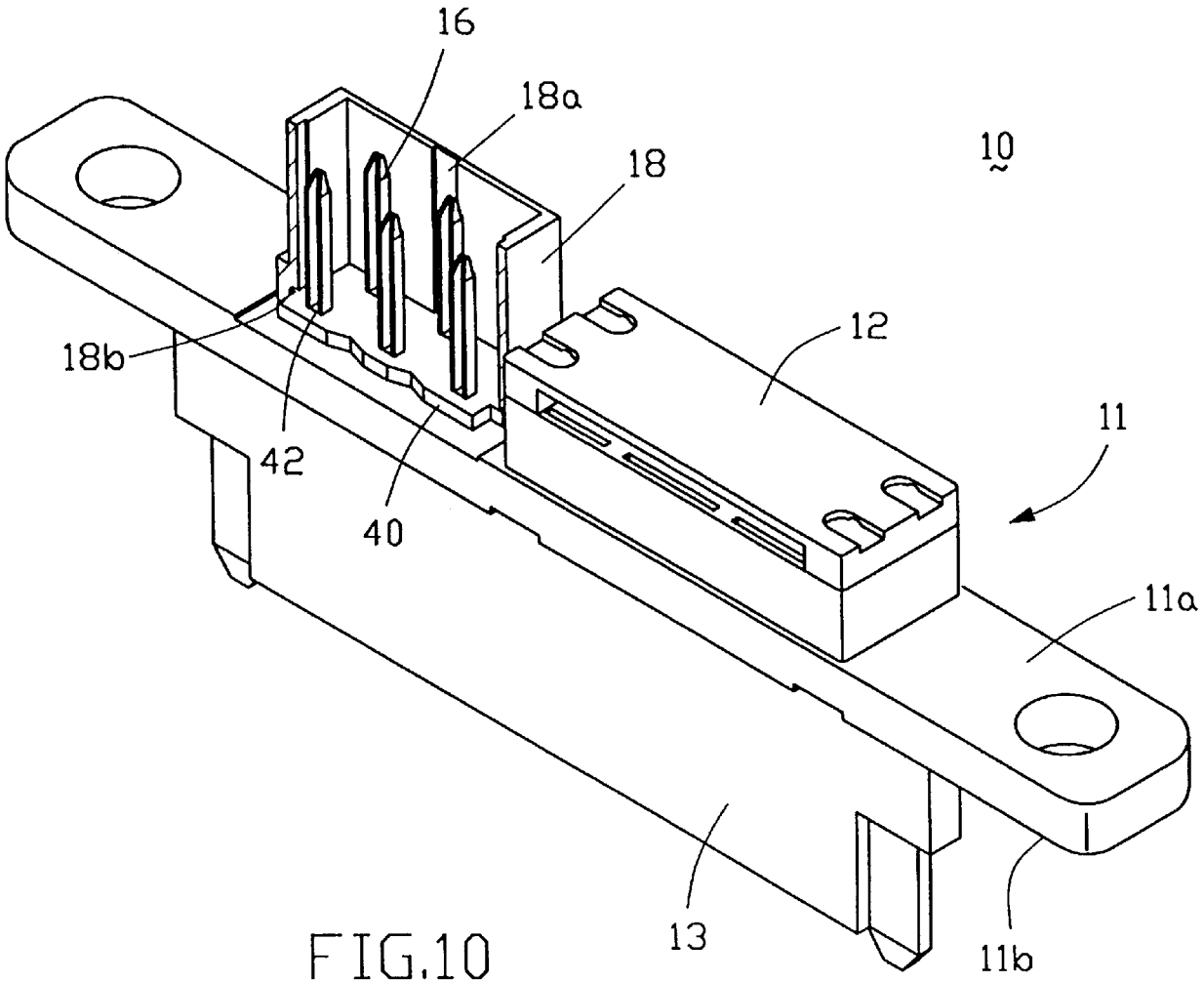
FIG. 10 is a perspective view of the buckhead connector with a portion of a peripheral wall is cutaway.

Referring to FIGS. 6, 6A and 10, a buckhead connector 10 in accordance with the present invention comprises a housing 11 defining a front face 11*a* and a rear face 11*b* opposite the front face 11*a*. A first contact section 12 is integrally formed on the front face 11*a* for connecting with a first connector (not shown). According to this embodiment, the first contact section 12 is an insulation displacement section suitable for termination with a flat flexible cable as shown in FIG. 1. Of course it can be another type of connector. A mating portion 13 extends from the rear face 11*b* for engagement with a corresponding connector (not shown).

The buckhead connector 10 further includes a second contact section 14 integrally formed on the front face 11*a* for connecting with a second connector (not shown). The second contact section 14 defines an array of passageways 14*a* each receiving a corresponding contact pin 16 therein. The contact pin 16 is similar to contact pin 91*a* of the prior art and extends beyond the front face 11*a*. The contact pins 16 serve as power pins for power transmission between devices.

A peripheral wall 18 extends from the front face 11*a* defining a space to surround the contact pins 16 therein. Four guiding slots 18*a* are defined in inner faces of the wall 18. A bottom of the slot 18*a* defines a retaining recess 18*b* for engagement with a portion of an alignment plate 40 when the latter is assembled thereto.

Figure 7:
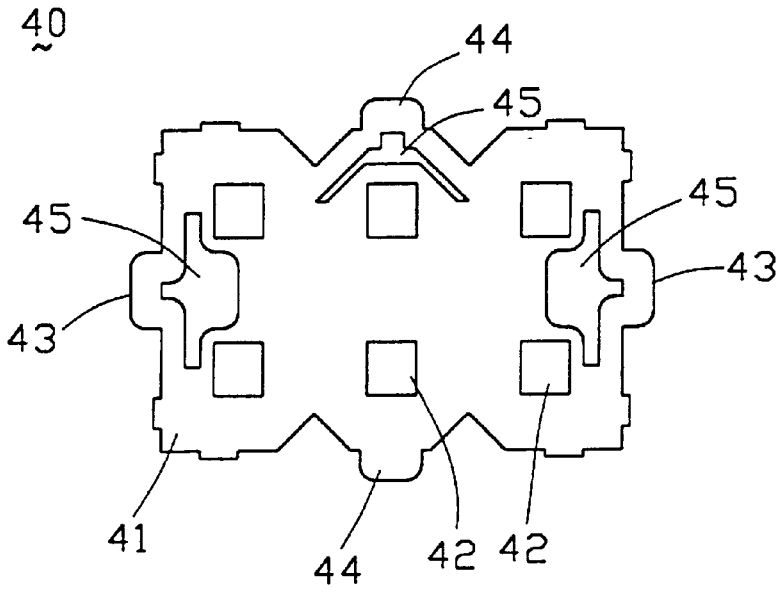
FIG. 7 is a front view of an alignment plate for use with the buckhead connector of FIG. 6.
Figure 8:
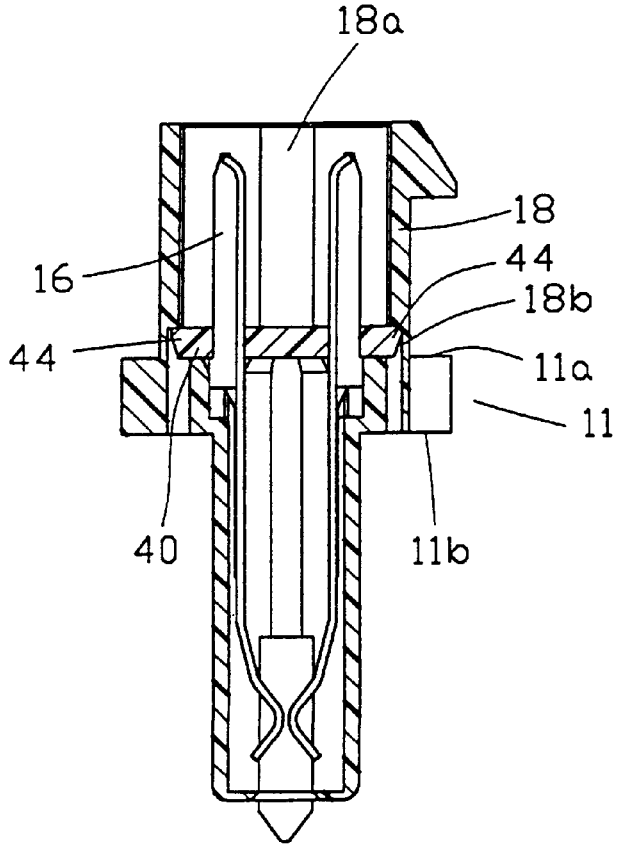
FIG. 8 is a cross sectional view of the passageway with the alignment plate assembled therein.

Referring to FIGS. 7 and 8, the alignment plate 40 in accordance with the present invention comprises a base portion 41 defining an array of openings 42 therethrough corresponding to the contact pins 16 of the buckhead connector 10. A pair of tabs 43 extend from traversal ends of said base portion 41 and each is movably received in the corresponding slots 18*a* of the wall 18. The tab 43 can be securely retained within the corresponding retaining recess 18*b* when the alignment plate 40 is seated. A second pair of tabs 44 is formed on longitudinal sides of the base portion 41. The base portion 41 further defines three deformation sections 45 adjacent to the tabs 43 and 44. Each deformation section 45 provides resilience to the corresponding tab 43 and 44. In order to ensure secure engagement between the tabs 43, 44 and the retaining recesses 18*b*, the distance between two longitudinal tabs 43 is longer than the distance between corresponding slots 18*a*. When the alignment plate 40 is assembled within the space defined by the wall 18, the tabs 43 are adapted to be received within the slots 18*a*. After the alignment plate 40 is finally seated, the tabs 43 extend into the corresponding recesses 18*b* and are securely retained therein. The tabs 44 behave in the same manner as the tabs 43.

Figure 9:
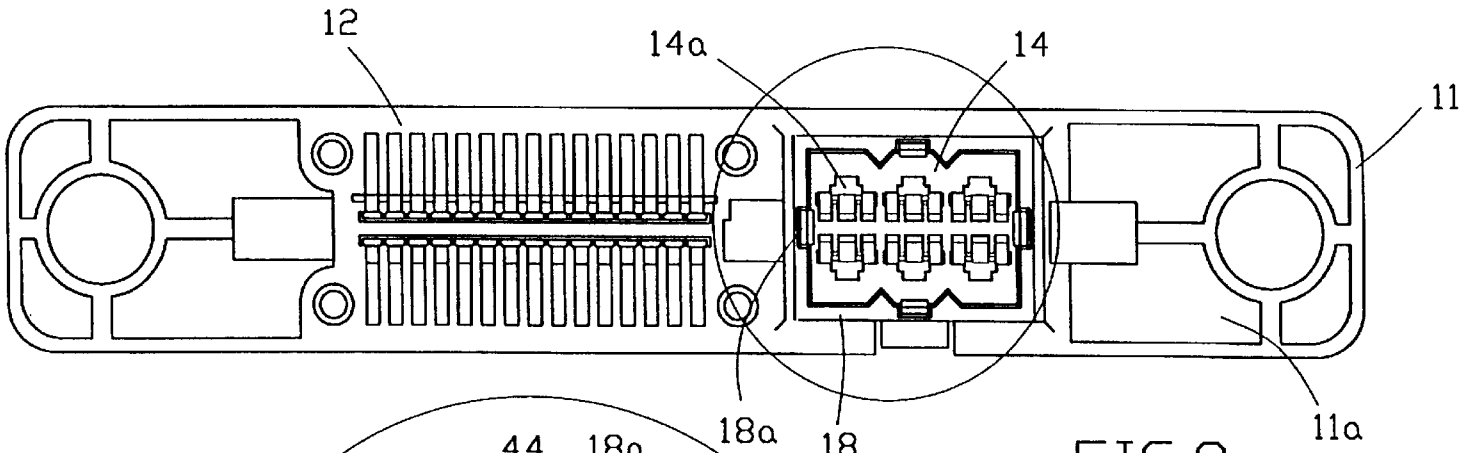
FIG. 9 is a front view of the buckhead connector when the alignment plate is assembled thereto.
Figure 9A:
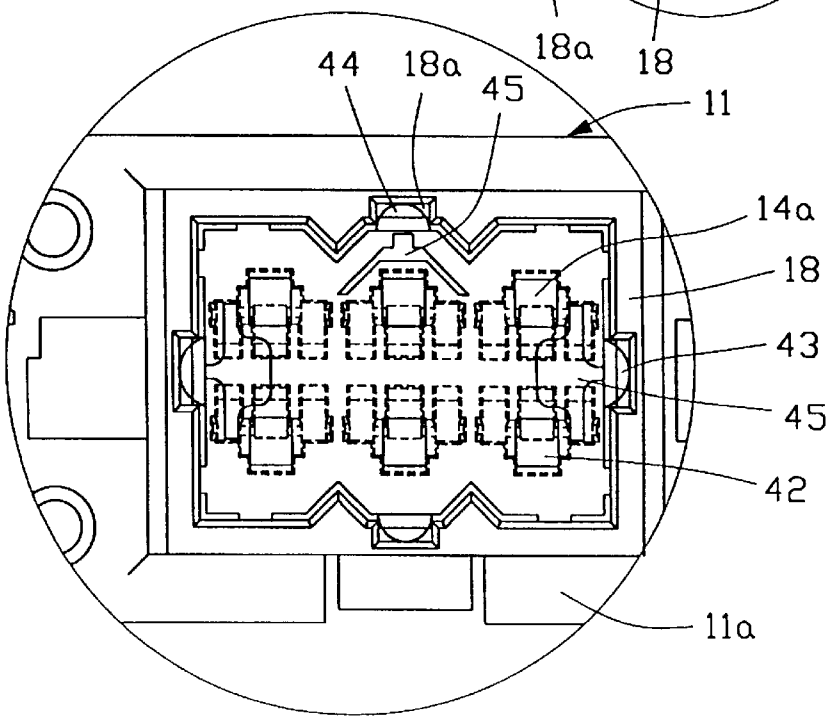
FIG. 9A is an enlarged view of the encircled portion of FIG. 9.

Referring to FIGS. 9 and 9A, after the alignment plate 40 is seated and the tabs 43 and 44 are received in the corresponding retaining recesses 18*b*, the passageways 14*a* are covered by the alignment plate 40. As shown in FIG. 10, the contact pins 16 extend through the openings 42 into the receiving space. By this arrangement, the contact pins 16 are correctly aligned as well as firmly rooted.

Figure 11A:
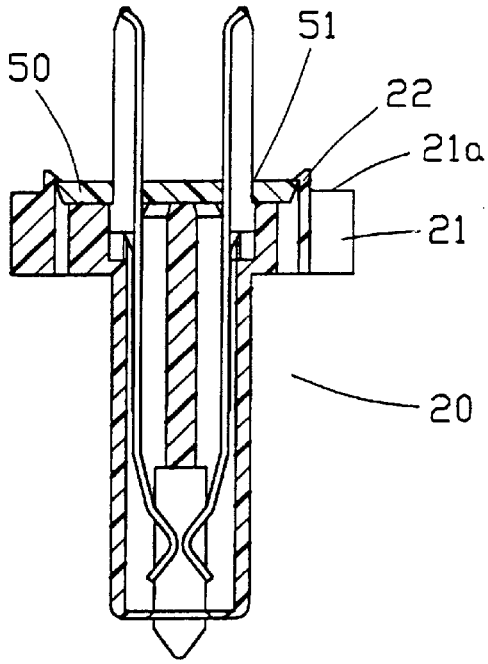
FIG. 11A is a cross sectional view of a buckhead connector in accordance with a second embodiment of the present invention.

FIG. 11A shows a buckhead connector 20 in accordance with a second embodiment of the present invention. The connector 20 includes a housing 21 forming a pair of locks 22 extending upward from a front face 21 a thereof. Edges of an alignment plate 50 can be firmly retained by the locks 22. The alignment plate 50 defines an array of openings 51 for extension of the contact pins 16 therethrough. By this arrangement, the contact pins 16 are correctly aligned.

Figure 11B:
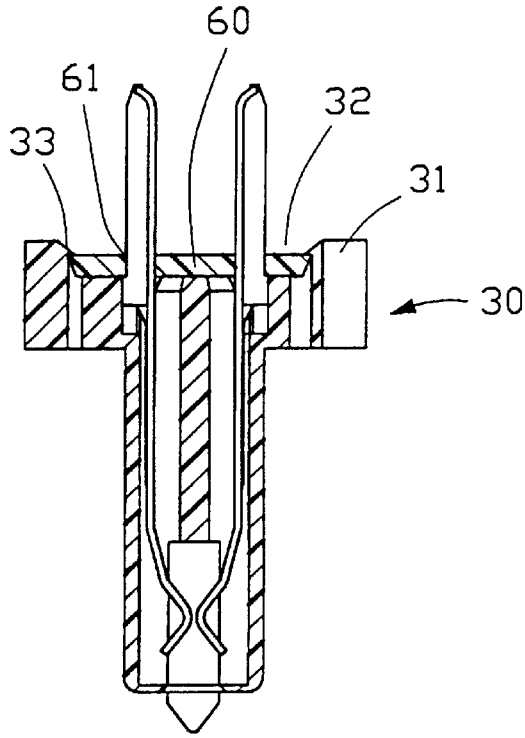
FIG. 11B is a cross sectional view of a buckhead connector in accordance with a third embodiment of the present invention.

FIG. 11B shows a buckhead connector 30 in accordance with a third embodiment of the present invention. The connector 30 includes a housing 31 defining a recess 32. A pair of barbs 33 extends into the recess 32 from inner faces thereof An alignment plate 60 can be received within the recess 32 and securely retained therein by the barbs 33. The alignment plate 60 defines an array of openings 61 for extension of the contact pins 16 therethrough. Accordingly, contact pins 16 are also firmly aligned and rooted.

Figure 12:
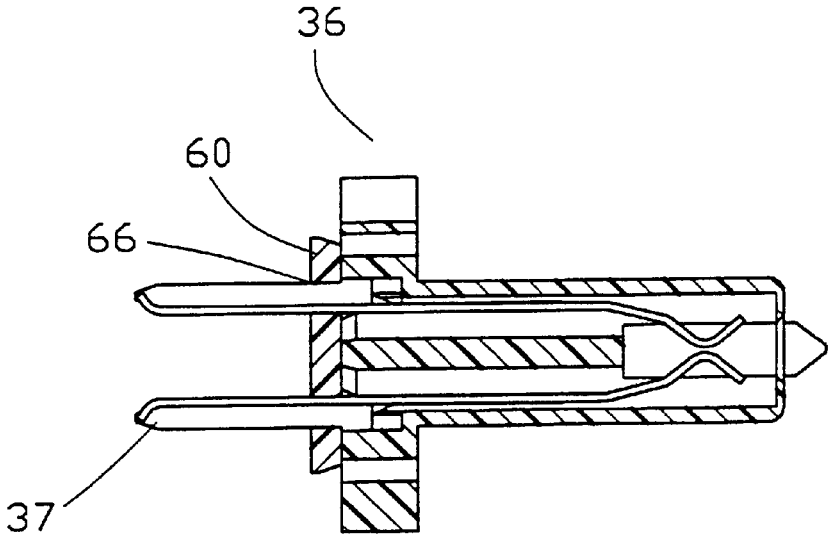
FIG. 12 is a cross sectional view of a buckhead connector in accordance with a fourth embodiment of the present invention.

FIG. 12 illustrates a buckhead connector 36 in accordance with a fourth embodiment of the present invention. An alignment plate 60 defines an array of openings 66 for interferentially engaging with contact pins 37 of the connector 36. After the alignment plate 60 is positioned, relative positions between contact pins 37 are fixedly set.

The feature of the invention is to provide a connector having a housing defining a plurality of passageways extending between a front face and a rear face thereof wherein each passageway is dimensioned to allow a cantilever arm of a corresponding contact pin to be inserted thereinto from the front face to the rear face while providing no support to prevent a header portion of that contact pin from transversely moving. The connector further includes an alignment plate adapted to be attached to the front face and defining a plurality of openings in alignment with the corresponding contacts to allow the header portions of the contact pins to restrictedly extend therethrough, respectively, so as to prevent transverse movement of the header portions of the contact pins. Under this situation, the alignment plate may cover the front opening of each passageway around the front face. Thus, the whole connector is a reliable anti-transverse movement design for the contact pins.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

What is claimed is:

1. An electrical connector, comprising:

a dielectric housing having a front face, a rear face opposite said front face, a mating portion extending from said rear face for mating with a complementary connector, and a first retaining means;

a first contact section integrally formed on said front face for connecting with a first connector;

a second contact section integrally formed on said front face for connecting with a second connector, said second contact section including at least a contact pin extending beyond said front face; and a flat alignment plate for being fixedly assembled to the dielectric housing, said alignment plate having an opening and a second retaining means, said opening having a configuration and size substantially corresponding to that of said contact pin for a fit insertion of said contact pin, the second retaining means of the alignment plate being deformable for being fixed to said first retaining means whereby said contact pin is firmly rooted in said dielectric housing;

wherein a peripheral wall extends from said front face and defines a receiving space for surrounding said contact pin therein;

wherein said alignment plate is interferentially engaged with inner faces of said peripheral wall;

wherein said alignment plate comprises a base portion forming at least a tab extending from one side thereof, and defining at least a deformation section in the base portion adjacent said tab, said tab and deformation section constituting the second retaining means;

wherein the first retaining means consists of at least a pair of retaining recesses in the inner face of the peripheral wall and the second retaining means consists of at least a pair of tabs on corresponding sides of the alignment plate, the tabs being engageable within the retaining recesses for positioning the alignment plate.

2. An electrical connector, comprising:

a dielectric housing having a front face, a rear face opposite said front face, a mating portion extending from said rear face for mating with a complementary connector, and a first retaining means;

a first contact section integrally formed on said front face for connecting with a first connector;

a second contact section integrally formed on said front face for connecting with a second connector, said second contact section including at least a contact pin extending beyond said front face; and a flat alignment plate for being fixedly assembled to the dielectric housing, said alignment plate having an opening and a second retaining means, said opening having a configuration and size substantially corresponding to that of said contact pin for a fit insertion of said contact pin, the second retaining means of the alignment plate being deformable for being fixed to said first retaining means whereby said contact pin is firmly rooted in said dielectric housing;

wherein said front face defines a recess for securely retaining said alignment plate therein;

wherein said front face forms at least a pair of barbs extending into the recess, the alignment plate being adapted to interferentially engage with the front face within the recess thereby positioning the contact pins;

wherein said alignment plate comprises a base portion forming at least a tab extending from one side thereof, and defining at least a deformation section in the base portion adjacent said tab, said tab and deformation section constituting the second retaining means.

* * * * *